United States Patent [19]

Klein et al.

[11] 4,027,556

[45] June 7, 1977

[54] MANUAL BLIND RIVETING TOOL

[75] Inventors: Günther Klein; Karl Spohr, both of Walldorf, Hessen, Germany

[73] Assignee: GESIPA Blindniettechnik Gesellschaft mit beschrankter Haftung, Frankfurt am Main, Germany

[22] Filed: Oct. 15, 1975

[21] Appl. No.: 622,499

[30] Foreign Application Priority Data

Oct. 7, 1975 Germany ..... 7531806[U]

[52] U.S. Cl. ..... 81/3 R; 72/391

[51] Int. Cl.[2] ..... B21J 15/34

[58] Field of Search ..... 72/391; 81/3 R

[56] References Cited

UNITED STATES PATENTS

| | | | |
|---|---|---|---|
| 3,048,296 | 8/1962 | Heidenwolf | 72/391 |
| 3,326,030 | 6/1967 | Dimaio | 72/391 |
| 3,334,509 | 8/1967 | Elliott | 72/391 |
| 3,596,496 | 8/1971 | La Pointe | 72/391 |

FOREIGN PATENTS OR APPLICATIONS

| | | | |
|---|---|---|---|
| 542,382 | 1/1942 | United Kingdom | 72/391 |

*Primary Examiner*—C.W. Lanham
*Assistant Examiner*—Gene P. Crosby
*Attorney, Agent, or Firm*—Ernest G. Montague; Karl F. Ross; Herbert Dubno

[57] ABSTRACT

A blind riveting tool has a base or holding member on which is pivoted a U-shaped clamping element which has a bight portion defining one side of a seat. Pivoted on this clamping element is a holding member formed with a jaw that can coact with the seat to grip the mandrel of a rivet whose head rests against the bottom side of the holding member. Both the displaceable member and the holding member have handles which when pivoted toward one another cause the jaw of the displaceable member to clamp a mandrel tightly against the seat and then pivot up, pulling this mandrel through its rivet and upsetting same.

8 Claims, 5 Drawing Figures

MANUAL BLIND RIVETING TOOL

FIELD OF THE INVENTION

The present invention relates to a blind riveting tool and, more particularly to a tool which is operated manually for use with synthetic-resin blind rivets.

BACKGROUND OF THE INVENTION

A blind rivet comprises a hollow rivet body formed at one end with a head and having a pin or mandrel extending longitudinally through the rivet and protruding from the head end. The mandrel is fitted into a riveting tool such that the head lies against an abutment on the tool. Actuation of the tool pulls the mandrel back through the rivet and upsets this rivet. The mandrel is sufficiently strong to upset the rivet but not pull all the way through it so that once a predetermined resistance has been met the mandrel breaks off, leaving the upset rivet and end of the mandrel together in the workpiece with the broken-off end of the mandrel still held in the tool.

When such a tool is used with rivets of aluminum or steel a relatively short stroke is all that is necessary to upset the rivet. In order properly to deform the rivet a relatively great force is needed so that the tool works with a considerable mechanical advantage. Thus a relatively wide displacement of the handles gives a relatively small displacement at the holding end of the tool.

Synthetic-resin rivets, frequently made of a rigid polyamide such as nylon, require a much greater working stroke to be properly upset. Thus when such rivets are set with a conventional blind-riveting tool it is often necessary to actuate the handle several times before the mandrel snaps off and the rivet is properly upset. Even a pneumatic or pneumatic-hydraulic blind riveting tool must be actuated several times to upset such rivets.

OBJECTS OF THE INVENTION

It is therefore an object of the present invention to provide an improved blind riveting tool.

Yet another object is the provision of such a tool which overcomes the above-given disadvantages.

A further object is to provide such a riveting tool which can be used with synthetic-resin rivets or other rivets with a wide material strength range.

SUMMARY OF THE INVENTION

These objects are attained according to the present invention in a blind riveting tool having an elongated holding member with a rearwardly extended handle and a front end, an elongated displaceable member pivoted at the front end on the holding member and itself having a rearwardly extending handle and a forwardly directed jaw. A clamping element is pivoted on the displaceable member adjacent to the jaw and is formed with a seat adjacent and turned toward the jaw. A blind-rivet mandrel can be clamped between the jaw and the seat so that displacement of the two handles toward each other will displace the mandrel so gripped relative to the front end of the holding member.

This clamping element, in accordance with the present invention, is generally U-shaped, having a pair of flanks that embrace the jaw end of the displaceable member. The bight portion connecting the two flanks forms the seat. The seat extends generally parallel to and the full length of the jaw formed at the front end of the displaceable member.

In accordance with further features of this invention, the clamping element is pivoted on the holding member and the displaceable member is itself pivoted on the clamping element. The holding member is formed with a through-going hole positioned such that the head of a blind rivet may be set against this hole with the mandrel extending through the hole and into the space between the jaw and the seat. Pivoting of the displaceable member back first brings the jaw against the mandrel to lock it in the seat, then the clamping element and holding member are both pivoted upwardly away from the hole to pull the mandrel through the rivet and upset this rivet.

With the system according to the present invention a relatively long stroke is obtained so that synthetic-resin blind rivets may readily be set. Even such rivets wherein the mandrel must be fitted separately to the rivet may be employed with the apparatus according to the present invention in a single operation.

BRIEF DESCRIPTION OF THE DRAWING

The above and other objects, features, and advantages of the invention will become more readily apparent from the following description, reference being made to the accompanying drawing in which.

SPECIFIC DESCRIPTION

Figure 1:
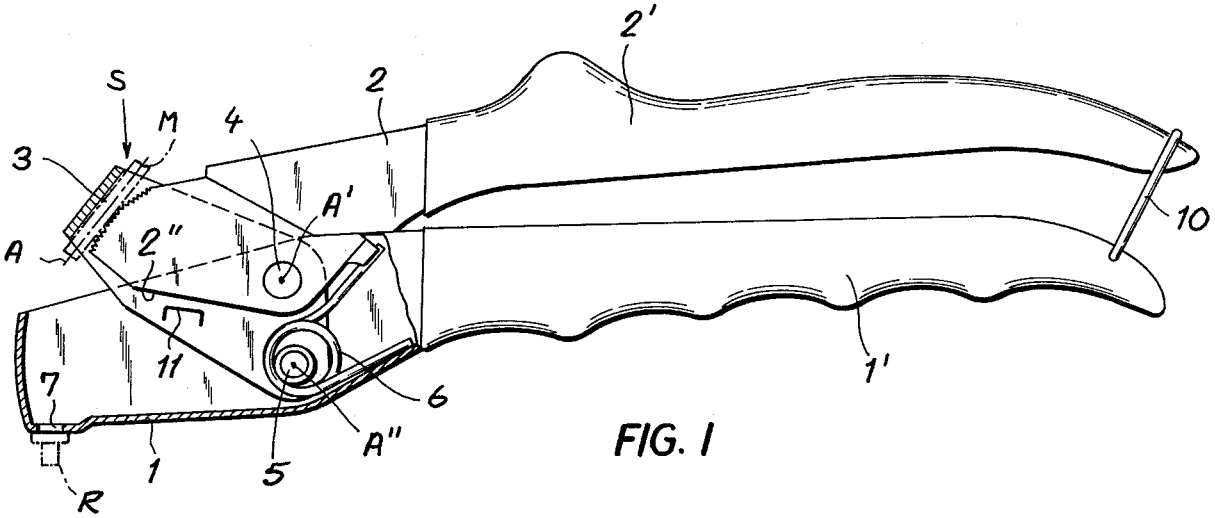
FIG. 1 is a side view partly in section through the apparatus according to this invention.
Figure 2:
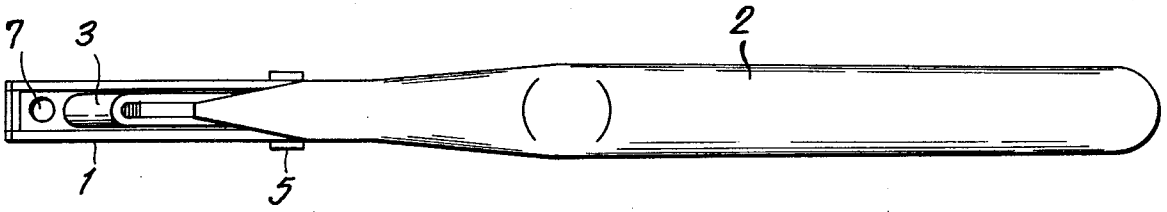
FIG. 2 is a top view of the apparatus of FIG. 1.
Figure 3:
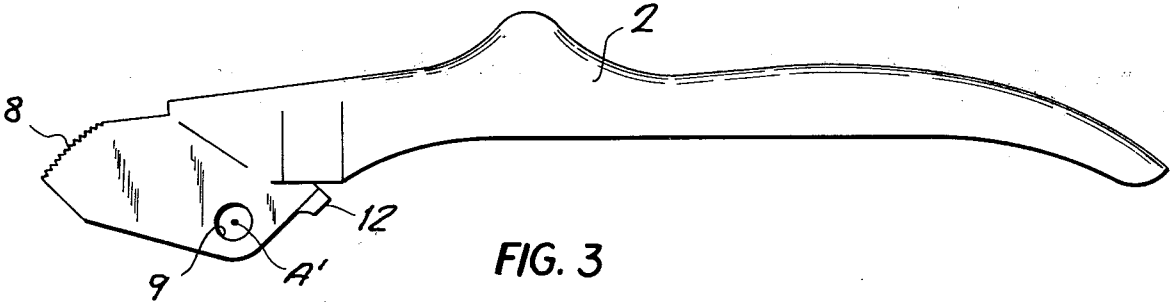
FIG. 3 is a side view of the displaceable member of the apparatus of FIG. 1, and FIGS. 4 and 5 are side and top views respectively of the clamping element of the riveting tool.

As shown in FIGS. 1 and 2 the apparatus according to the present invention basically comprises a holding member 1, a displaceable member 2, and a clamping element 3 interconnected by means of pivot pins 4 and 5. All of these elements are made of steel.

The holding element 1 is formed with a rearwardly extending handle 1′ and, adjacent its front end with a throughgoing hole 7. The pivot pin 5 is journaled at its two ends as indicated in FIG. 2 in the two sides of the holding member 1.

Figure 4:
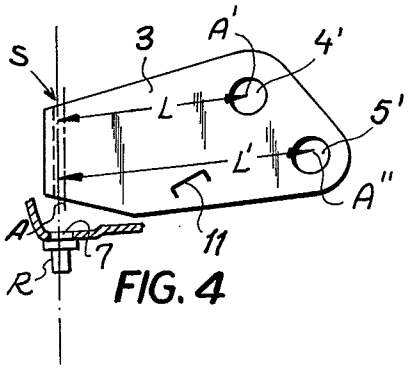

The displaceable member 2 is similarly formed with a rearwardly extending handle 2′ extending generally parallel to the handle 1′. The front end of this member 2 is formed with a toothed jaw portion 8 lying on a surface of an imaginary circle whose center coincides with the center of throughgoing hole 9 formed in the member 2. A wire bale 10 may be flipped up as shown in FIG. 1 to hold the two handles 1′ and 2′ close and parallel to each other. As can be seen from FIG. 4, the hole 7 has an axis H which is at a smaller perpendicular distance L from the axis A′ than the perpendicular distance L′ from the axis A″.

Figure 5:
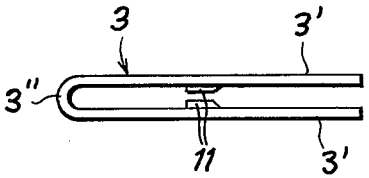

The clamping element 3 is generally U-shaped as indicated in FIG. 5 and has a pair of sides 3′ that normally flank the front end of the displaceable member 2. These sides are formed with in-line bores 4′ and 5′ through which the pins 4 and 5 pass. The pin 4 thus passes through the hole 9 in the front end of the displaceable member 2. The clamping element 3 is pivoted on the holding element 1 and the displaceable member 2 is in turn pivoted on the clamping element 3. The toothed jaw sector 8 on the member 2 therefore defines a seat S having an axis A with the bight portion 4'' between the two flanks 3' of the element 3.

Each of the flanks 3' of the element 3 is formed with an inwardly bent tab 11 which is engageable with the lower edge 2'' of the member 2. A torsion spring 6 between the flanks 3' and surrounding the pivot pin 5 defining axis A'' has one side bearing against an abutment 12 on the member 2 and another side bearing against the inside of the hollow member 1 so as to urge the elements 2 and 3 to rotate counterclockwise as seen in FIG. 1 about their respective axes A'' and A' defined by the pins 5 and 4 respectively. Engagement of the surface 2'' with the tabs 11 will push the members 2 and 3 around such that the axis A of the seat S aligns with the bore 7.

In use a blind rivet R as shown in dot-dash lines in FIG. 1 is fitted with its head against the undersurface of the member 1 and its mandrel M passing through the hole 7 and received between the jaw 8 and the bight 3'' in the seat S.

As the handle 2' is moved toward the handle 1' the jaw 8 will first approach the bight portion 3'' to seize the mandrel M firmly. Further rotation of the handle 2' in this direction therefore tilts back the clamping element 3 as shown in FIG. 1 and pivots it up away from the rivet R so as to pull the mandrel M through this rivet R and upset the rivet.

After the mandrel has been pulled and broken off, completing the riveting operation, the handle 2' may be released so as to pivot the two elements counterclockwise back to their original positions and allow the mandrel M to drop out of the seat S.

We claim:

1. A blind riveting tool comprising:

an elongated holding member having a rearwardly extending handle and a front end;

an elongated displaceable member pivoted at said front end and having a rearwardly extending handle displaceable toward and away from said handle of said holding member and a forwardly directed jaw; and a clamping element pivoted on said displaceable member adjacent said jaw and formed with a seat adjacent and turned toward said jaw, whereby a blind-rivet mandrel can be clamped between said jaw and said seat and displaced relative to said front end on pivoting of said handles relative to each other, said holding member being formed with a hole dimensioned to receive a blind rivet mandrel and alignable with said seat, the pivot for said element on said holding member lying between the pivot of said displaceable member on said clamping element and said hole, said clamping element being generally U-shaped and has a pair of elongated sides flanking said jaw and a bight interconnecting said sides and forming said seat, said pivots being formed on the free ends of said sides.

2. The tool defined in claim 1 wherein said seat extends the full length of said jaw and transverse to said handle of said displaceable member.

3. The tool defined in claim 1 wherein said holding spring means urging said handles apart and displacing said jaw away from said seat.

4. The tool defined in claim 1 wherein said jaw is formed with teeth.

5. The tool defined in claim 4 wherein said jaw is generally arcuate.

6. The tool defined in claim 1 wherein said holding member has a pair of sides and is provided with a pivot pin anchored therein and passing through said clamping element.

7. The tool defined in claim 6, further comprising another pivot pin passing only between said sides of said clamping element and through said displaceable member.

8. A manually operable blind riveting tool for the upsetting of especially synthetic-resin blind rivets having respective mandrels, said tools comprising:

a housing formed with an opening adapted to receive a mandrel of a blind rivet to be upset by the tool and forming a support for said rivet around said hole, said housing being provided with a first handle extending away from said tool;

a U-shaped gripper element pivotally mounted in said housing at a first axis and having a bight swingable into proximity of said hole for engagement with said mandrel and a pair of shanks extending from said bight toward said first pivot axis;

a second handle pivotally connected to said element for swinging movement relative thereto about a second pivot axis; and a gripper jaw formed rigidly on said second handle disposed between said shanks and reaching toward said bight for engaging said mandrel between said bight and said jaw, the perpendicular distance of said second axis from the axis of said hole being less than the perpendicular distance of said first axis from the axis of said hole, the perpendicular distance of the first axis from the plane of said hole being less than the perpendicular distance of said second axis from said plane, said first and second axes being spaced apart by a smaller distance than the distance of either of them from the axis of said hole.

* * * * *